US006705802B2

(12) United States Patent
Radwan

(10) Patent No.: US 6,705,802 B2
(45) Date of Patent: Mar. 16, 2004

(54) TEMPORARY SUPPORT FOR OFFSHORE DRILLING PLATFORM

(75) Inventor: Abobakr M. Radwan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/222,335

(22) Filed: Aug. 16, 2002

(65) Prior Publication Data

US 2004/0033110 A1 Feb. 19, 2004

(51) Int. Cl.[7] ..... E02B 17/08; B66F 1/00

(52) U.S. Cl. ..... 405/196; 405/198; 405/203; 114/265; 254/95; 254/108

(58) Field of Search ..... 405/195.1, 196, 405/197, 198, 203, 224; 254/89 R, 95, 94, 97, 105–112; 114/264, 265

(56) References Cited

U.S. PATENT DOCUMENTS

| | | | | |
|---|---|---|---|---|
| 3,343,371 A | | 9/1967 | Heitkamp | |
| 3,435,621 A | * | 4/1969 | Johnson | 254/106 |
| 4,160,538 A | * | 7/1979 | Armstrong | 254/89 R |
| 4,255,069 A | | 3/1981 | Yielding | |
| 4,269,543 A | | 5/1981 | Goldman et al. | |
| 4,270,877 A | * | 6/1981 | Post | 405/198 |
| 4,389,140 A | | 6/1983 | Bordes | |
| 4,422,802 A | * | 12/1983 | Choate | 405/198 |
| 4,479,401 A | | 10/1984 | Korkut | |
| 4,488,705 A | * | 12/1984 | Sutton | 254/108 |
| 4,505,616 A | | 3/1985 | Grzelka et al. | |
| 4,538,938 A | | 9/1985 | Grzelka et al. | |
| 4,589,799 A | | 5/1986 | Hotta et al. | |
| 4,627,768 A | | 12/1986 | Thomas et al. | |
| 4,657,437 A | * | 4/1987 | Breeden | 405/198 |
| 4,662,787 A | | 5/1987 | Tatsuguchi | |
| 4,722,640 A | * | 2/1988 | LeTourneau | 405/196 |
| 4,902,169 A | | 2/1990 | Sutton | |
| 5,092,712 A | | 3/1992 | Goldman et al. | |
| 5,139,366 A | | 8/1992 | Choate et al. | |
| 5,188,484 A | | 2/1993 | White | |
| 5,224,798 A | * | 7/1993 | Thomas | 405/198 |
| 5,486,069 A | | 1/1996 | Breeden | |
| 5,611,645 A | | 3/1997 | Breeden | |
| 5,622,452 A | | 4/1997 | Goldman | |
| 5,906,457 A | | 5/1999 | Choate et al. | |
| 5,915,882 A | | 6/1999 | Darwiche et al. | |
| 6,076,996 A | | 6/2000 | Choate et al. | |

FOREIGN PATENT DOCUMENTS

| | | | | |
|---|---|---|---|---|
| JP | 61053910 | * | 3/1986 | 405/196 |

* cited by examiner

*Primary Examiner*—Jong-Suk (James) Lee
(74) *Attorney, Agent, or Firm*—Abelman, Frayne & Schwab

(57) ABSTRACT

A support device is used to facilitate maintenance of a jacking system of a self-elevating drilling or maintenance platform having a plurality of legs supporting the platform in an operating orientation. The platform includes jacking mechanisms associated with the legs to raise and lower the platform using jacking racks on each leg chord. Support devices temporarily support the platform independent of the jacking mechanisms using a rack chock removably clamped in place on each leg with locking teeth on the rack chock meshed with jacking teeth on the leg's jacking rack. In this manner the platform can be temporarily supported by using removable fasteners to secure a rack chock to each leg chord beneath the platform hull, lowering the platform relative to the legs so that the hull rests on a support seat on each support device, and then disengaging the jacking mechanism from the jacking teeth on the legs for maintenance of the jacking system.

17 Claims, 3 Drawing Sheets

FIG. 2A
PRIOR ART
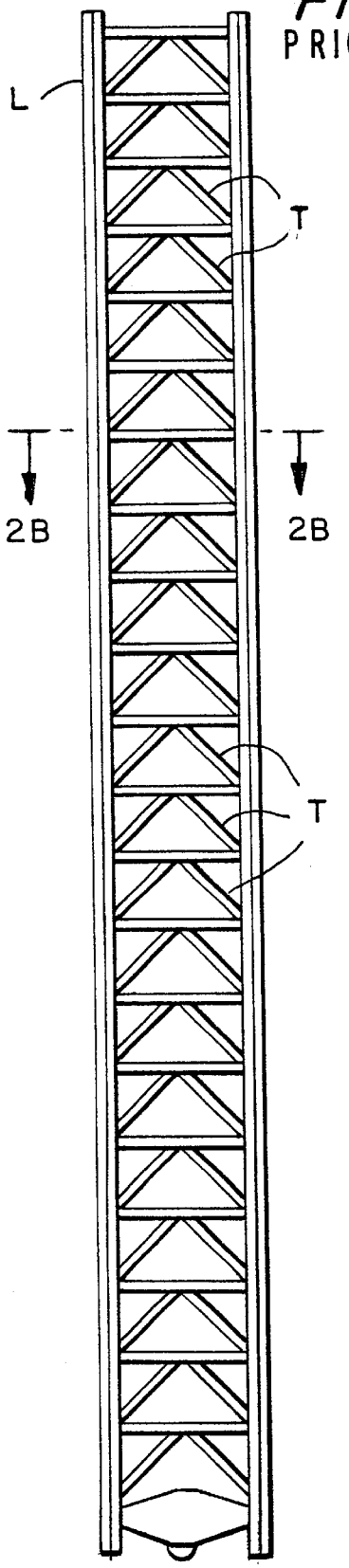
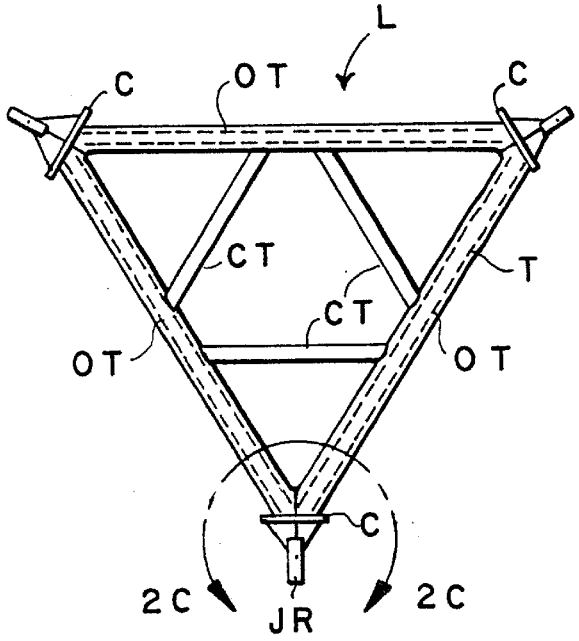
FIG. 2B
PRIOR ART
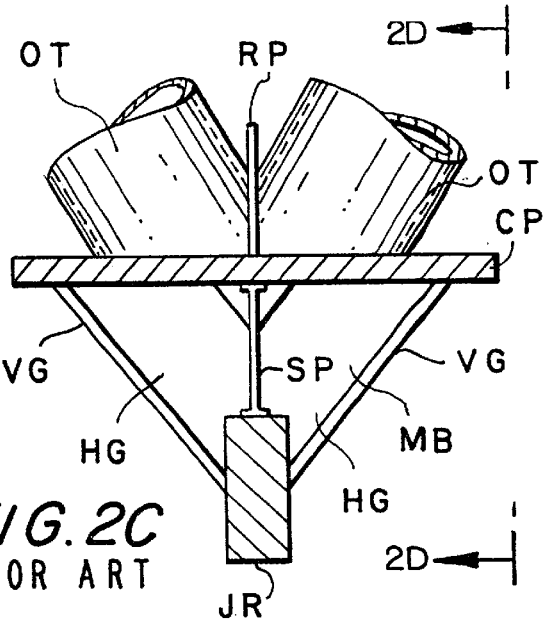
FIG. 2C
PRIOR ART

TEMPORARY SUPPORT FOR OFFSHORE DRILLING PLATFORM

BACKGROUND OF THE INVENTION

1. Field of the Invention

The present invention relates generally to a self-elevating drilling or maintenance platform, and more particularly to a device for temporarily supporting such a platform to permit in situ maintenance on its jacking components.

2. Description of the Related Art

Drilling platforms are commonly used for offshore exploration and extraction of petroleum products from beneath the seabed.

One type of such platform is supported by legs that are lowered by a jacking system into the seabed. After the platform is elevated above the water, it is held in position by the jacking system to form a stable drilling platform. It is difficult to maintain the jacks and associated equipment, especially in older types of such platforms, without taking the platform out of service and towing it to a drydock. It would be preferable to support the platform in situ for such maintenance.

Examples of drilling platforms that include platform-supporting structure are shown in U.S. Pat. Nos. 3,343,371, 4,269,543, 4,389,140, 4,538,938, 4,627,768, 5,092,712, 5,139,366, 5,188,484, 5,486,069, 5,611,645, 5,622,452 and 6,076,996. However, none of them solve the problem of permitting maintenance of a drilling platform's jacking system and associated parts when the platform has no way of supporting itself other than the jacking system.

SUMMARY OF THE INVENTION

It is an object of the present invention to overcome the problems of the prior art by using a support device that can support a drilling platform in situ.

In accordance with one aspect of the invention, a support device for a drilling platform supported by at least one leg including a jacking rack with jacking teeth for meshing with a jacking mechanism for raising and lowering the platform comprises a rack chock having a portion with at least one locking tooth for meshing with the jacking teeth on the jacking rack and a support seat for engaging the platform, a clamping portion attachable to the rack chock, and removable fasteners for securing the clamping portion to the rack chock to hold the rack chock in place on the leg with the locking tooth meshed with at least one of the jacking teeth on the jacking rack.

In accordance with another aspect of the invention, a drilling or maintenance platform comprises a plurality of legs supporting the platform in an operating orientation, each leg including a jacking rack with jacking teeth, a plurality of jacking mechanisms associated with the legs for meshing with the jacking teeth to raise and lower the platform, and a plurality of support devices for supporting the platform independent of the jacking mechanisms, each device including (i) a rack chock having a portion with at least one locking tooth for meshing with the jacking teeth of an associated leg and a support seat for engaging the platform, (ii) a clamping portion attachable to the rack chock, and (iii) removable fasteners for -securing the clamping portion to the rack chock to hold the rack chock in place on the leg with the locking tooth meshed with at least one of the jacking teeth.

In accordance with yet another aspect of the invention, a method of temporarily supporting a self-elevating drilling platform supported in an operating orientation by a plurality of legs, each including a jacking rack with jacking teeth for meshing with a jacking system for raising and lowering the platform comprises providing a like plurality of rack chocks, each having a portion with at least one locking tooth meshed with the jacking teeth, a support seat for engaging the platform, and a clamping portion attachable to the rack chock, using removable fasteners to secure each clamping portion to an associated rack chock with the locking tooth thereof meshed with at least one of the jacking teeth of the associated leg so that the support seat is beneath a hull portion of the platform, lowering the platform relative to the legs so that the hull portion rests on the support seats, and disengaging the jacking mechanism from the jacking teeth.

These and other objects, features and aspects of the present invention will become apparent from the following detailed description of the preferred embodiments, taken together with the following drawings.

BRIEF DESCRIPTION OF THE DRAWINGS

An exemplary embodiment of the invention is explained in more detail with reference to the following drawing figures, in which:

FIG. 2 illustrates a leg for supporting the platform shown in FIG. 1, wherein FIG. 2A is an elevation view of the leg, FIG. 2B is a section taken along lines 2B—2B in FIG. 2A, FIG. 2C is a detail of portion 2C—2C indicated in FIG. 2B.

In the drawings, the same components are given the same reference numbers or letters in the different figures.

DETAILED DESCRIPTION OF PREFERRED EMBODIMENTS

Figure 1:
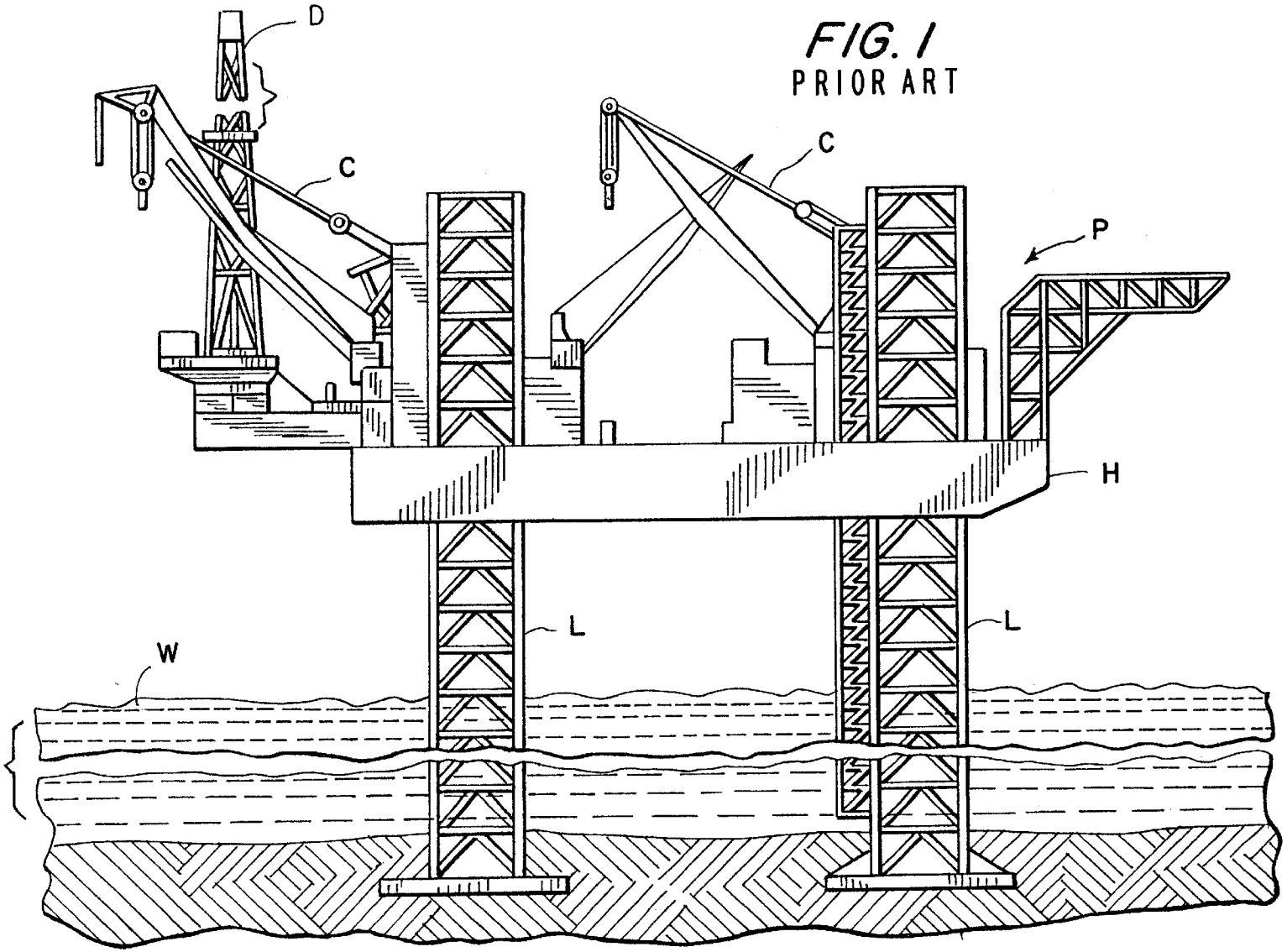
FIG. 1 PRIOR ART
FIG. 1 is a schematic depiction of a conventional drilling self-elevating platform with which the present invention may be used.

FIG. 1 depicts a self-elevating offshore drilling platform P of the type with which the present invention may be used. It includes a hull H supported above the surface of the water by legs L. Typically, three or four legs support the floor, with one leg at each corner of the hull. As this description proceeds, it will be apparent that the number of legs is not important for purposes of the present invention. The platform P includes standard drilling equipment, such as cranes C, at least one derrick D and so forth.

The hull H conventionally comprises a floating body by which the platform is transported to the site at which it is to be used. The legs L are then lowered until they meet the seabed S. Continued lowering of the legs L elevates the hull H above the surface of the water W a suitable distance that provides an air gap to account for wave height and other factors that are well known to those skilled in this art. This is a conventional operation that is described in more detail in other documents, such as U.S. Pat. Nos. 4,269,543 and 4,902,169.

Figure 2D:
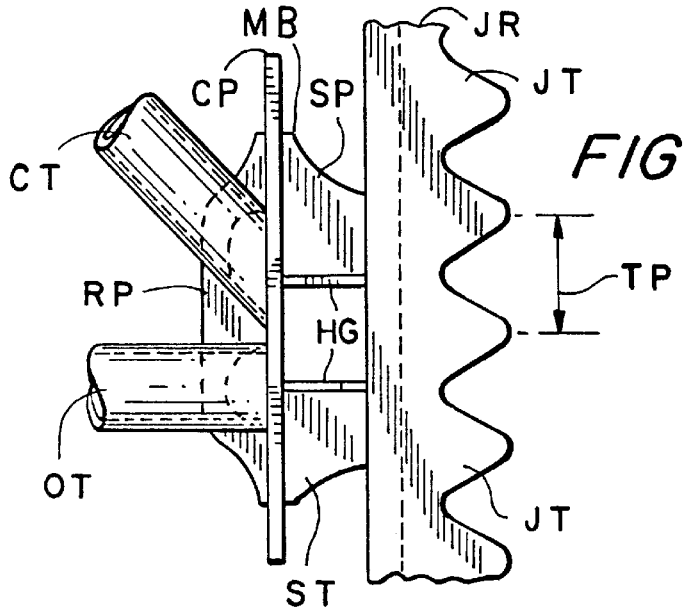
FIG. 2D is a view in the plane 2D—2D in FIG. 2C.

FIGS. 2A–2D illustrate one of the legs L. FIG. 2A is an elevation view, depicting the lattice structure T that typifies such legs. As shown more clearly in FIG. 2B, the lattice structure is triangular in cross-section normal to the longitudinal extent of the leg L. FIGS. 2C and 2D show in more detail the manner in which a chord plate CP is disposed at each corner of the triangle and a reinforcing plate RP welded to the chord plate extends inwardly toward the center of the truss structure. A plurality of outer truss members TO and cross-truss members CT are welded to the chord plate CP and the reinforcing plate RP to form a structure that is extremely strong and rigid in all directions. In a typical installation, the outer truss members OT are 12" diameter pipe sections, and the cross truss members CT are 4" diameter pipe sections. The chord plate CP is 1¾" thick and the reinforcing plate is ¾" thick. These members are made of steel. Other dimensions and grades of materials can be used depending on the environment and operating conditions encountered in using the platform.

As seen particularly in FIGS. 2C and 2D, a continuous jacking rack JR is secured to the lattice structure T at one of the comers of the triangular leg. The jacking rack is a 2" thick steel plate mounted to the chord plate CP at the comer by mounting brackets MB disposed at predetermined intervals along the chord plate CP. Each mounting bracket MB includes a pair of ½" thick steel standoff plates SP having one edge welded to the chord plate CP and the other edge welded to the back of the jacking rack JR. Additional reinforcing members in the form of ½" thick steel horizontal gusset plates HG and ½" thick steel vertical gusset plates VG plates are welded variously to the chord plate CP, the standoff plates S, the jacking rack JR and each other to provide rigidity in all directions. (The vertical gusset plates VG are omitted from FIG. 2D for clarity.) As with the other components of the leg L, different dimensions and materials can be used for the components just described depending on the environment and operating conditions encountered in using the platform.

In operation, the platform P is elevated by jacks (not shown) at the comer locations on the platform P where the legs extend through the hull H. The jacking rack JR has on its outer edge a series of jacking teeth JT at a predetermined pitch TP. The teeth JT on the portion of a leg L extending through the platform hull H engage one or more pinion gears on one or more jacks mounted on the hull H. As jacking motors cause the pinion gears to rotate, the legs L are lowered into the water. The teeth JT on successive leg sections form a continuous jacking rack. In this fashion the legs are lowered until they sink into the seabed S and anchor securely therein. Further jacking elevates the platform above the surface of the water W. The hull is secured in position relative to the legs L by brakes (not shown) incorporated into the jacking system.

This is a conventional manner of setting up a platform for undersea drilling operations. However, on occasion the jacks and the brakes must be inspected or serviced or both. In platforms without other structure for locking the hull to the legs, this requires that the legs be extracted from the seabed and the platform towed to a drydock. Clearly a system whereby the jacks and brakes can be made accessible in situ would be preferable to taking the platform out of service for such maintenance.

Figure 3:
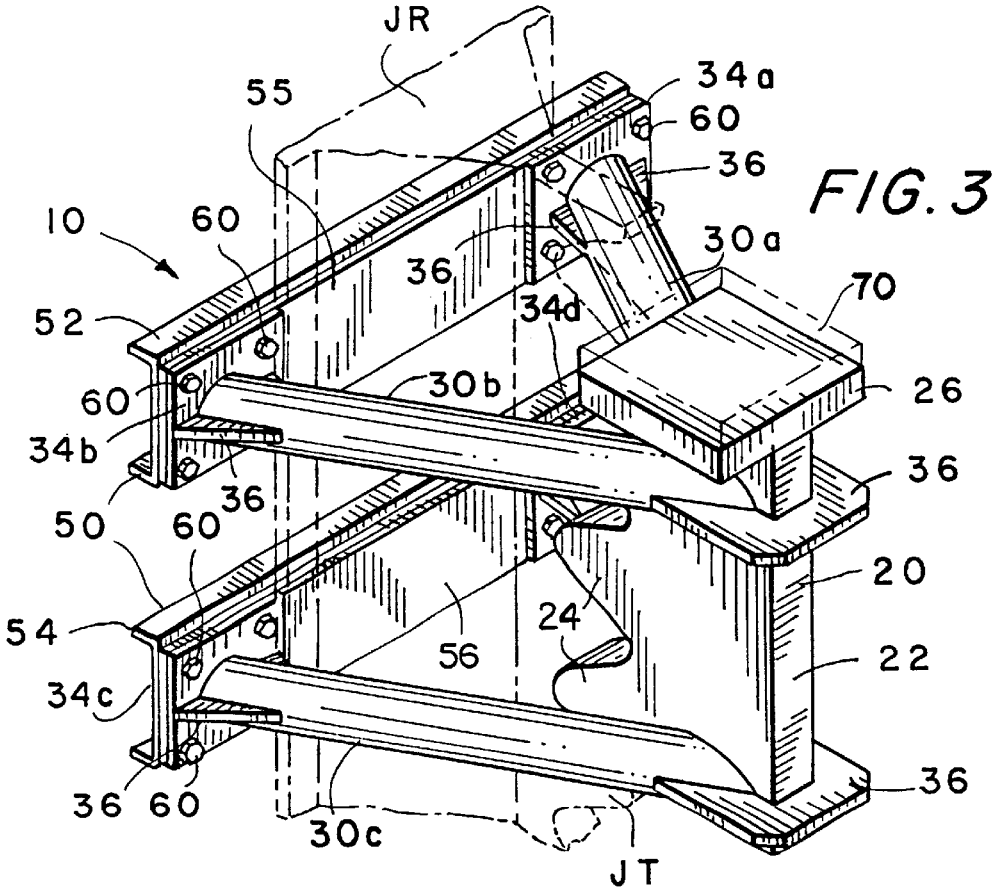
FIG. 3 is a perspective view of an embodiment of the supporting device of the present invention shown in use on a platform leg such as that depicted in FIG. 2.

The present invention, an embodiment of which is shown in FIG. 3, solves this problem. A support device 10 in accordance with the illustrated embodiment of the invention includes a rack chock 20 that is made of a steel rack plate 22 of the same thickness as the jacking rack JR. The plate 22 includes on one edge thereof a series of teeth 24 at a predetermined pitch that matches the pitch TP of the teeth JT on a first side of the jacking rack JR (shown in phantom in FIG. 3). The rack chock 20 includes a support seat 26 on which the hull H of the platform P rests while the support device 10 is in use. The seat is typically made of one or more steel plates 2" thick attached by welding, for example, to the top edge of the rack plate. The rack chock 20 also includes a plurality of clamping arms 30 consisting of pipes or other suitable shapes made of an appropriate material such as steel. Only three of the bracing arms 30*a* to 30*c* are shown in FIG. 3. The fourth is "hidden" behind the rack plate, but is in a similar orientation to the arm 30*a* and located on the side of the rack plate 22 opposite the arm 30*c*. One end of each bracing arm is welded to the steel rack plate 22 at an angle to the side surface of the plate as shown in FIG. 3. The distal end of each arm 30 is welded to a mounting plate 34*a* to 34*d*, respectively. The mounting plates 34*a* to 34*d* in the present embodiment made of steel plate 1" thick. Additional rigidity is provided by gussets 36 welded in place as shown in FIG. 3. Additional gussets may be used as needed, depending on the platform's weight.

The support device 10 further includes a clamping portion 50 that secures the rack chock 20 in place on the leg L. In the present embodiment, the clamping portion includes a first clamping bar 52 and a second clamping bar 54. The clamping bars in the present embodiment are steel channels 1" thick, although other materials may be used. They are welded to 1" thick backing plates 55 and 56, respectively. Through holes are provided proximate to each end of the clamping bars 52 and 54, and those holes align with complementary holes in the mounting plates 34*a* to 34*d*. Bolts 60 passing through the holes secure the clamping bars 52 and 54 to the mounting plates. Bolt size is chosen in accordance with the weight of the platform.

In use, a rack chock 20 is secured to each leg L under the platform P, with the support seat 26. To accomplish this, the rack chock 20 is put in place with the rack teeth 22 meshed with the jacking teeth JT on the jacking rack JR. The mounting plates 34*a* to 34*d* are bolted to their associated clamping bars 52 and 54 (and backing plates 55 and 56) as shown in FIG. 3. The length of the clamping arms 30 is such that the rack plate 22 can be drawn tightly against the first side of the jacking rack JR having the jacking teeth by drawing the clamping bars against the opposite, second side of the jacking rack JR. This securely clamps the jacking rack between the rack plate and the clamping bars. The platform P can then be lowered so that the hull rests on the seat plate 26 at the corner of each leg, and the jacks and brakes can be dismantled or otherwise made accessible for maintenance. The rack chock 20 is located relative to the jacking rack 20 so that the required air gap is provided when the platform is lowered onto the seat plate 26.

Once the maintenance is complete the jacks can be again placed in service platform raised above the seat plate 26. This takes the load off of the supporting devices 10. The bolts 60 are then removed and the devices 10 are dismantled and removed from the legs.

The support device 10 of this embodiment of the invention has sufficient versatility to allow for variations in the level of the platform relative to each leg. That is, the hull H might in fact be held at a different position relative to the leg at each corner of the platform. This condition could occur because it is necessary to make the platform level in spite of variations in the seabed that can affect the distance to which each leg extends below the platform. Such variations can be accounted for with the support device 10 by in effect varying the thickness of the support seat 26 and/or the length of the rack plate 22. A convenient manner of making such an adjustment is by using a spacer 70, shown in phantom in FIG. 3, between the underside of the platform hull H and the top of the seat plate 26. A similar approach could be taken if the placement of the rack chock 20 with the seat 26 immediately adjacent to the floor would interfere with a mounting bracket MB holding the jacking rack JR to the leg. (See FIG. 2D.) In that case, a block could be interposed between the hull and the seat 26.

It will be appreciated that the present invention is particularly adapted for use with existing platforms that have no other provision for maintenance of the jacks, brakes and associated structure. That is, there are platforms now in use in which the jacking system and brakes are the sole means of supporting the platform on the legs. The present invention permits the jacks, brakes and associated mechanisms of such platforms to be maintained without taking the platform out of service. It should also be noted that the invention can be adapted for use with drilling, service, or maintenance platforms having alternate constructions. For example, some platforms use legs with dual jacking racks. Those skilled in the art will readily appreciate that the rack chock and other components of the embodiment discussed above can be adapted for use with such an arrangement.

While the present invention has been described with reference to the foregoing embodiment, changes and variations may be made therein which fall within the scope of the appended claims. Further changes and variations may be made thereto which are within the scope of the appended claims. All such modifications and/or changes are intended to be within the scope of the claims.

What is claimed is:

1. A support device for a drilling platform supported by at least one leg including a jacking rack with jacking teeth for meshing with a jacking mechanism for raising and lowering the platform, the device comprising:

a rack chock having a portion with at least one locking tooth for meshing with the jacking teeth on the jacking rack and a support seat for engaging the platform;

a clamping portion attachable to said rack chock; and removable fasteners for securing said clamping portion to said rack chock to hold said rack chock in place on the leg with said locking tooth meshed with at least one of the jacking teeth on the jacking rack.

2. A support device as in claim 1, wherein said rack chock comprises a rack plate with a plurality of locking teeth at an edge of said plate, said locking teeth having a predetermined pitch matching a pitch of the jacking teeth.

3. A support device as in claim 2, wherein said rack chock further comprises at least one bracing arm secured on each side of said rack plate and extending at an angle to a surface of said rack plate.

4. A support device as in claim 3, wherein said rack chock includes two or more said bracing arms secured to each side of said rack plate.

5. A support device as in claim 3, wherein said rack chock further includes mounting plates, one of which is secured at a distal end of each said bracing arm for attachment to said clamping portion.

6. A support device as in claim 3, wherein the jacking teeth are disposed on a first side of the jacking rack and said clamping portion comprises a clamping bar for contacting a second side of the jacking rack opposite the first side to clamp the jacking rack between said rack chock and said clamping bar using said removable fasteners.

7. A support device as in claim 6, wherein said rack chock comprises two or more bracing arms secured on each side of said rack plate and extending at an angle to a surface of said plate and a mounting plate secured at a distal end of each said bracing arm for attachment to said clamping bar.

8. A support device as in claim 7, wherein said mounting plates and said clamping bars have cooperating through holes therein and said removable fasteners comprise bolts extending through said holes and cooperating nuts for securing together said mounting plates and said clamping bars.

9. A support device as in claim 3, wherein said support seat comprises a support plate secured to an edge of said rack plate.

10. A drilling or maintenance platform comprising:

a plurality of legs supporting said platform in an operating orientation, each said leg including a jacking rack with jacking teeth;

a plurality of jacking mechanisms associated with said legs for meshing with said jacking teeth to raise and lower the platform; and a plurality of support devices for supporting the platform independent of said jacking mechanisms, each said device including (i) a rack chock having a portion with at least one locking tooth for meshing with said jacking teeth of an associated said leg and a support seat for engaging the platform, (ii) a clamping portion attachable to said rack chock, and (iii) removable fasteners for securing said clamping portion to said rack chock to hold said rack chock in place on said leg with said locking tooth meshed with at least one of the jacking teeth.

11. A platform as in claim 10, wherein each said rack chock comprises:

a rack plate with a plurality of locking teeth at an edge of said plate, said locking teeth having a predetermined pitch matching a pitch of said jacking teeth, and said support seat comprising a support plate secured to another edge of said rack plate;

two or more bracing arms secured on each side of said rack plate and extending at an angle to a surface of said rack plate; and a mounting plate secured at a distal end of each said bracing arm for attachment to said clamping portion.

12. A platform as in claim 11, wherein said jacking teeth are disposed on a first side of each said leg of said platform and each said rack chock includes two said bracing arms secured to each side of said rack plate, with said clamping portion comprising a clamping bar for contacting a second side of said leg opposite said first side to clamp said leg between said rack chock and said clamping bar, and said removable fasteners include bolts and associated nuts extended through cooperating holes in said clamping bars and said mounting plates.

13. A method of temporarily supporting a self-elevating drilling platform supported in an operating orientation by a plurality of legs, each including a jacking rack with jacking teeth for meshing with a jacking system for raising and lowering the platform, the method comprising:

providing a plurality of rack chocks, each having a portion with at least one locking tooth meshed with the jacking teeth, a support seat for engaging the platform, and a clamping portion attachable to the rack chock;

using removable fasteners to secure each clamping portion to an associated rack chock with the locking tooth thereof meshed with at least one of the jacking teeth of the associated leg so that the support seat is beneath a hull portion of the platform;

lowering the platform relative to the legs so that the hull portion rests on the support seats; and disengaging the jacking mechanism from the jacking teeth.

14. A method as in claim 13, wherein each rack chock comprises:

a rack plate with a plurality of locking teeth at an edge of the plate, the locking teeth having a predetermined pitch matching a pitch of the jacking teeth, and the support seat comprising a support plate secured to another edge of the rack plate;

at least one bracing arm secured on each side of the rack plate and extending at an angle to a surface of the rack plate; and a mounting plate secured at a distal end of each bracing arm for attachment to the clamping portion.

15. A method as in claim 14, wherein the jacking teeth are disposed on a first side of each leg of the drilling platform and each rack chock includes two or more bracing arms secured to each side of the rack plate, with the clamping portion comprising a clamping bar for contacting a second side of the leg opposite the first side to clamp the leg between the rack chock and the clamping bar using removable bolts.

16. A method as in claim 14, the method further comprising the step of inserting at least one spacer between the support plate on at least one rack chock and the platform to level the platform while resting on the support plates.

17. A method as in claim 13, further comprising the steps of:

engaging the jacking system with the jacking teeth on the jacking racks;

raising the platform from the support seats; and removing the rack chocks from the legs of the platform.

* * * * *